US006742510B2

(12) United States Patent
Troncoso, Jr.

(10) Patent No.: US 6,742,510 B2
(45) Date of Patent: Jun. 1, 2004

(54) ARCHERY ARROW REST ASSEMBLY INCLUDING A FUNNEL

(76) Inventor: Fernando V. Troncoso, Jr., 16990 Wildwood Dr., Montrose, CO (US) 81401

( * ) Notice: Subject to any disclaimer, the term of this patent is extended or adjusted under 35 U.S.C. 154(b) by 0 days.

(21) Appl. No.: 09/771,836

(22) Filed: Jan. 29, 2001

(65) Prior Publication Data

US 2002/0100468 A1 Aug. 1, 2002

(51) Int. Cl.[7] ..... F41B 5/22
(52) U.S. Cl. ..... 124/44.5
(58) Field of Search ..... 124/24.1, 44.5; 141/337

(56) References Cited

U.S. PATENT DOCUMENTS 2,924,253 A * 2/1960 Beddow
3,815,646 A * 6/1974 Coakley ..... 141/337
4,858,589 A 8/1989 Chang
4,917,072 A 4/1990 Chang
5,042,450 A * 8/1991 Jacobson ..... 124/44.5
5,460,153 A 10/1995 Huntt ..... 124/44.5
5,896,849 A 4/1999 Branthwaite et al. ..... 124/44.5

* cited by examiner

*Primary Examiner*—John A. Ricci
(74) *Attorney, Agent, or Firm*—Christopher Braddock

(57) ABSTRACT

A substantially conically shaped arrow rest having a substantially centered aperture through which the shaft of the arrow is adapted to extend. The arrow rest possesses several slits extending from the aperture so that when the arrow is shot, the aperture may distend to accommodate distortions of the arrow shaft and to allow the arrow vanes to pass substantially freely therethrough. Also preferably the arrow rest resiliently deflects radially outwardly in the region of the aperture so as to produce a biasing force that dampens the oscillations of the arrow upon being shot.

37 Claims, 6 Drawing Sheets

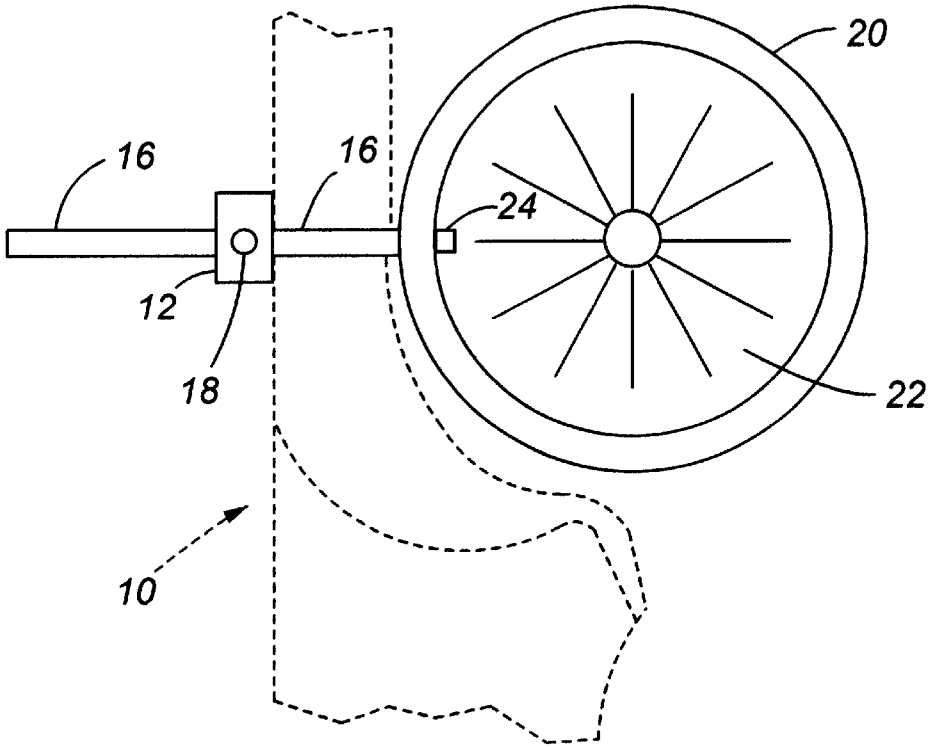
Fig. 1
Fig. 2
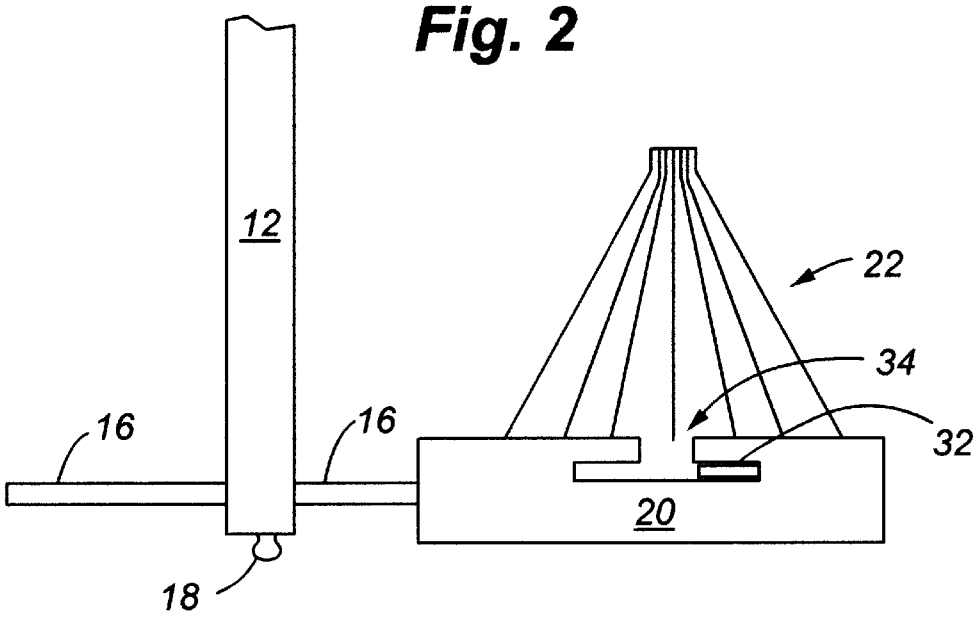

Fig. 3
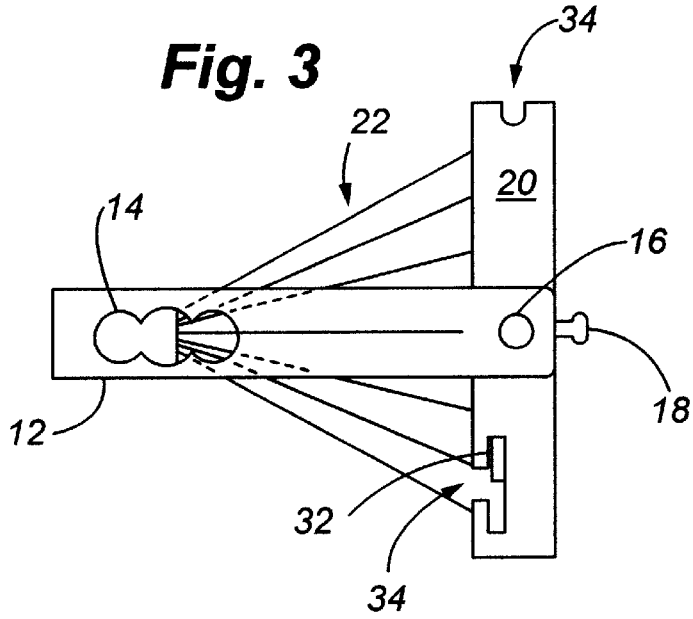
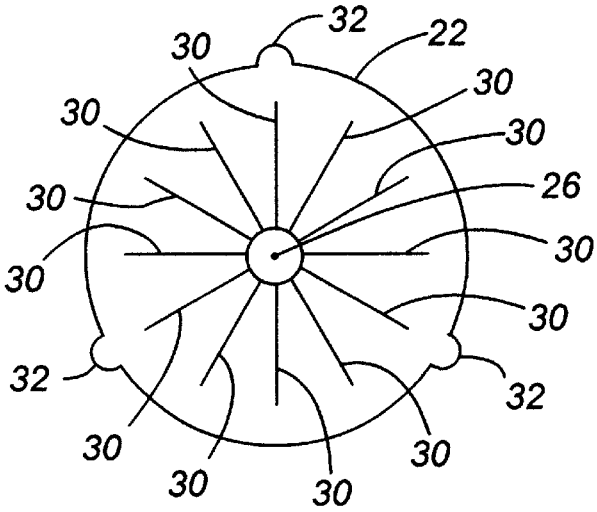
Fig. 4
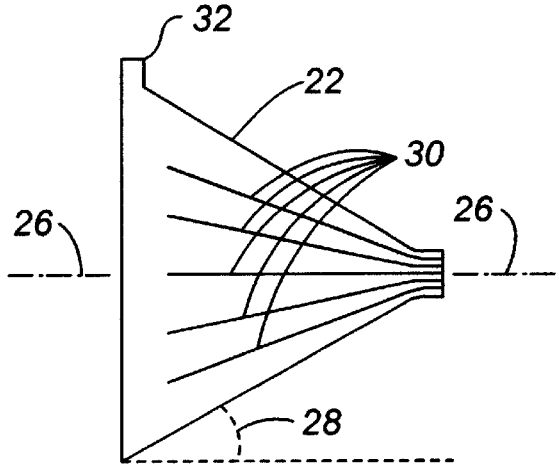
Fig. 5

62
52
54
50
60
56
48
58
62

ARCHERY ARROW REST ASSEMBLY INCLUDING A FUNNEL

FIELD OF THE INVENTION

The present invention generally relates to archery, and more particularly to an arrow rest assembly including a funnel, as well as to the funnel itself.

BACKGROUND OF THE INVENTION

Archery bows, such as compound bows, conventionally possess a handle riser section generally where an archer grasps the bow with one of the archer's hands. The handle riser section includes a window section through which an arrow extends when the arrow is in a "ready-to-draw-and-shoot position", when the arrow is drawn rearwardly as the bowstring is pulled, and momentarily after release of the bowstring and during the initial shooting of the arrow.

When an arrow is shot and released, the arrow bends and oscillates. A number of arrow rests have been designed to help resiliently absorb any flexing or thrust of the arrow in order to improve arrow flight and accuracy. Many of these arrow rests operate with the arrow shaft perched above or laterally adjacent to a resiliently flexible portion of the arrow rest, which is designed to provide free clearance of the arrow vanes or feathers when the arrow is shot and released.

Early, simple arrow rests might comprise simply a finger or a launcher arm that is screwed, glued or otherwise affixed to the bow in the region of the window section. Later, more sophisticated arrow rests might include spring biasing mechanisms as well as mechanisms to adjust the forward/rearward, upward/downward, and left/right position of the finger or launcher arm in the window section of the bow.

A common frustrating and even dangerous problem with most arrow rest designs is that it is difficult to place and maintain the arrow in a proper position on the arrow rest prior to drawing and during drawing of the bowstring.

During bow hunting, the archer typically desires to have an arrow in a "ready-to-draw-and-shoot" position so that a shot may be taken quickly and so that the game is not spooked by the movement and possible sound of drawing an arrow from a quiver, placing the arrow on the bow, and raising the bow to a shooting position. With a simple bow and elementary arrow rest designs, the bow hunting archer usually retains the arrow in a "ready-to-draw-and-shoot" position by placing the bowstring in the nock of the arrow and clasping the forefinger of the archer's bow-holding hand around the arrow shaft. Such a technique is tiring to the bow-holding hand and is sometimes dangerous when the bow hunter is walking through brush, tree limbs, or rough terrain, especially when considering that the arrow is usually fitted with a razor sharp broad head tip suited for hunting game. With the advent of more sophisticated bows and arrow rests, the use of a forefinger to hold the arrow is even more fraught with difficulty.

Also, when drawing an arrow rearwardly, the arrow may roll or fall off the arrow rest, which requires the arrow to be replaced and re-drawn. While such arrow "roll off" can be frustrating during target practice and disconcerting during tournaments, "roll off" is especially troublesome during hunting, when the archer may be relatively nervous, standing on unstable and uneven terrain, or encountering difficult weather conditions. During hunting, a "roll off" (1) may result in the arrow banging against the arrow rest or the bow, thereby creating noises that scare the game, (2) may require the archer to move the archer's hand, the arrow, or the bow, which movement may also scare the game, or (3) may require the archer to delay the arrow shot, during which time the game may move into concealment or out of range.

Arrow holders have been designed to help hold an arrow in the window of a bow. However, many of these holders unduly restrict the arrow so as to hamper arrow flight.

SUMMARY OF THE INVENTION

The present invention generally relates to a substantially conically shaped arrow rest having a substantially centered aperture through which the shaft of the arrow is adapted to extend. The arrow possesses several slits extending from the aperture so that when the arrow is shot, the aperture may distend to accommodate distortions of the arrow shaft and to allow the arrow vanes to pass substantially freely therethrough. Also preferably the arrow rest resiliently deflects radially outwardly in the region of the aperture so as to produce a biasing force that dampens the oscillations of the arrow upon being shot.

BRIEF DESCRIPTION OF THE DRAWING

The invention will be described with reference to the accompanying drawings wherein:

FIG. 1 is a schematic rear elevation of an arrow rest in accordance with one embodiment of the present invention;

FIG. 2 is a schematic top elevation of the arrow rest as shown in FIG. 1;

FIG. 3 is a schematic side elevation of the arrow rest as shown in FIGS. 1 and 2;

FIG. 4 is a schematic rear elevation of a cone shaped funnel that may be used in connection with the arrow rest as shown in FIGS. 1–3;

FIG. 5 is a schematic side elevation of the funnel as shown in FIG. 4;

DESCRIPTION OF A PREFERRED EMBODIMENT

Figure 6:
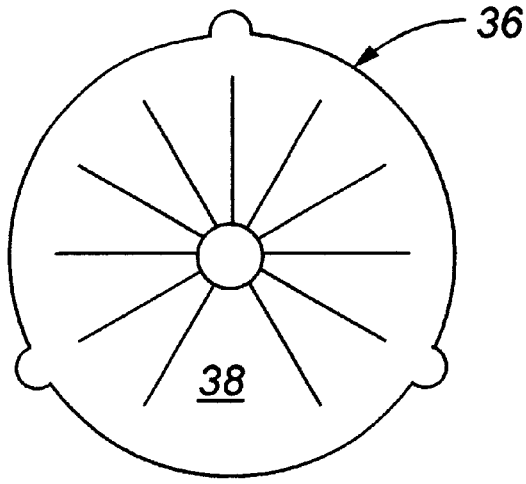
FIG. 6 is a schematic rear elevation of another cone shaped funnel that may be used in connection with the arrow rest shown in FIGS. 1–3.

The present invention will be described with reference to the accompanying drawings, wherein like reference numerals refer to the same item. There is shown in FIG. 1 in phantom lines an archery bow 10 which may be a compound bow or other type of bow. The portion of the bow 10 as shown in FIG. 1 is generally known as the handle riser section, which includes an arrow window in which an arrow (not shown) is adapted to be disposed immediately prior to drawing the arrow, during the drawing of the arrow, and during the shooting of the arrow from the bow 10.

The arrow rest assembly of a preferred embodiment of the present invention may broadly be construed as including a mounting bracket, a shaft, and a funnel shaped arrow holding and launching member.

An arrow rest utilizing the funnel of the present invention may be mounted directly to the handle riser section of the bow 10, may be installed in an overdraw bracket assembly, or most preferably, may be employed with a mounting bracket 12, as shown in FIGS. 1–3. The mounting bracket 12 may be fashioned of a planar, rectangular piece of metal. In a conventional manner, the mounting bracket may possess a series of three overlapping, transversely extending circular holes 14 having their centers longitudinally aligned, as best shown in FIG. 3. A conventional screw or bolt (not shown) adapted to extend into a conventional threaded receptacle (not shown) in the handle riser section of the bow 10 may extend through any one of the three overlapping holes 14. By selecting which of the three overlapping holes 14 through which to extend the conventional screw or bolt, the position of the mounting bracket 12 may be correspondingly moved in a forward or rearward direction relative to the bow 10. By tightening the screw or bolt, the mounting bracket 12 may be securely clamped against the handle riser section of the bow 10. It should also be appreciated that the mounting bracket 12 may also rotate or pivot about the conventional screw or bolt, which correspondingly raises or lowers the rearward end of the mounting bracket 12 with respect to the bow 10.

The end of the mounting bracket 12 opposite to the three overlapping holes 14 also possesses a transverse hole therethrough which is adapted to receive a shaft or rod 16 therethrough. A threaded hole disposed in the end of the mounting bracket 12 extends to the transverse hole adapted to receive the shaft 16. A threaded screw 18 extends through the threaded hole in the end of the mounting bracket 12 such that by tightening the screw 18, the tip of the screw clamps against the shaft 16 to selectively fix the shaft 16 in both a selected translational position and a selected rotational position with respect to the mounting bracket 12. By untightening the screw, the shaft 16 may be disengaged from the mounting bracket 12, or the shaft 16 may be translated or rotated with respect to the mounting bracket 12 and reclamped by means of the screw 18 to a different selected translational and rotational position.

The arrow rest also includes an arrow holding and launching member including a ring 20 and a funnel 22. The ring 20 is preferably fashioned in the shape of a short segment of a cylindrical tube with an inner diameter of approximately 5 centimeters. The diameter of the inner diameter of the ring is preferably large enough to permit substantially free clearance of the arrow feathers, fletching, or vanes through the ring 20 (i.e., when the arrow is shot, the arrow vanes ideally do not contact, or at most only very lightly contact, the ring 20). It is within the scope of the present invention that the ring 20 may be a variety of shapes other than strictly circular or tubular.

The ring 20 may be secured to the shaft 16 in following manner. A hole radially extends through the ring 20 and is adapted to align with a distal end of the shaft 16, which distal end includes a threaded hole axially extending therein. A screw 24 is adapted to extend through the radially extending hole in the ring 20 and into the threaded hole in the distal end of the shaft 16 such that the ring 20 is clamped against the distal end of the shaft 16. It would be appreciated that the ring 20 may be rotated about the axis of the shaft 16 and that the screw 24 may be used to selectively clamp the ring 20 in a selected rotational position with respect to the shaft 16.

It should be appreciated that the connection of the mounting bracket 12 to the bow 10, the connection of the shaft 16 to the mounting bracket 12, and the connection of the ring 20 to the shaft 16 permits the archer to select the position of the arrow holding and launching member in forward-rearward, left-right, and up-down directions.

That is, the archer possesses the freedom to selectively position the member within a three dimensional space in the window of the bow 10.

As best shown in FIGS. 4 and 5, in a preferred embodiment of the present invention, the funnel 22 preferably comprises a single piece of thin-walled material fashioned in a substantially conical shape, with the axis of the cone designated by the line 26. Although the preferred shape of the funnel 22 is substantially conical, it will be appreciated that the funnel 22 may assume a curved, contoured, or tapered shape. As shown in FIG. 5, the angle of taper of the substantially conically shaped funnel is preferably in the range of about 20 to 80 degrees, and more preferably in the range of about 30 to 60 degrees. Preferably, the diameter of the base end of the funnel 22 is between 3.5 to 5.5 centimeters, and more preferably between 4.0 to 5.0 centimeters. The distance from the base of the funnel 22 to the top of the funnel 22 is preferably in the range of 2–4 centimeters, and more preferably about 2.5–3.5 centimeters. Also, although the funnel 22 of the preferred embodiment uniformly possesses a roughly uniformly thin wall, it should be appreciated that the thickness of the walls may not be totally uniform, such as where the funnel 22 is fashioned of a relatively thick wall near the base thereof and a relatively thin wall near the tip thereof. Again, preferably the funnel 22 possesses a thin wall having a substantially uniform thickness in the range of about 0.5 to 2.0 millimeters, and more preferably in the range of between about 0.8 to 1.4 millimeters.

The funnel 22 is oriented with its base end at a relatively rearward position with respect to the bow 10 and the top end of the funnel 22 in a relatively forward position with respect to the bow 10.

As best shown in FIG. 5, the tip of the funnel 22 preferably possesses a substantially circular aperture centrally disposed about the axis 26 of the cone shaped funnel 22. As best shown in FIG. 4, the diameter of the aperture is preferably about 3.0 to 7.0 millimeters in a rest state. Preferably, the aperture in a rest state possesses a diameter slightly smaller than the diameter of the shaft of the arrow with which the arrow rest is to be used. Because the shafts of arrows vary slightly, it is preferred that the diameter of the aperture be selected so as to be smaller than the smallest diameter of most conventional arrow shafts.

The funnel 22 possesses a series of slits both longitudinally and radially extending from the tip of the funnel 22 to a position slightly spaced from the base end of the funnel 22. Preferably, the slits 30 are of equal length. As best shown in FIG. 4, preferably the slits 30 are disposed in an equiangular array from the tip of the funnel 22. As such, the funnel 22 possesses a series of wedge-shaped fingers, with each finger defined by two adjacent slits 30. Although the preferred embodiment includes twelve equiangularly arranged slits 30, the invention contemplates that the funnel 22 may possess at least four slits, and between 8 to 10 slits.

The funnel 22 is preferably fashioned of metal or plastic, such as nylon, TEFLON®, polyethylene or other plastic materials. The funnel 22 of the preferred embodiment is constructed and configured so that the wedge-shaped fingers of the funnel 22 may resiliently deflect radially outwardly from the conical axis 26. When such radial deflection occurs, the slits 30 widen, especially in the region of each slit toward the top end of the funnel 22.

From viewing FIGS. 4 and 5, it will be appreciated that the arrow shaft will generally be oriented along the axis 26 of the cone such that the region of the funnel 22 in the vicinity of the central aperture will contact the arrow shaft substantially completely about the periphery of the arrow shaft. Because the diameter of the central aperture is slightly smaller than the diameter of the arrow shaft, the funnel 22 will radially compress against the arrow shaft in the vicinity of the aperture thereby restraining the arrow shaft from any radial movement or longitudinal movement with respect to the funnel 22. Thus, the funnel 22 helps hold an arrow in a "ready-to-draw-and-shoot" position. When the arrow is drawn rearwardly, the top end of the funnel 22 which is preferably curled or flared radially outwardly, permits the arrow shaft to be drawn through the central aperture without encountering significant resistance and without any screeching or other noise. When the arrow is shot from the bow, the arrow shaft bends and flexes due to the extreme forces longitudinally exerted through the arrow shaft. Regardless of the radial direction of the flexing or bending of the arrow shaft, the funnel 22 resiliently absorbs the arrow shaft in such direction, which avoids any bumping of the arrow shaft against the funnel 22, while at the same time dampening such flexing and bending, which improves arrow flight and accuracy. The arrow vanes will pass through the funnel 22 with minimal resistance primarily due to the internal tapered configuration of the funnel 22, due to the radially outward flexibility of the wedge-shaped fingers of the funnel 22, and due to the widening of the slits 30 when the central aperture is distended radially outward.

Figure 12A:
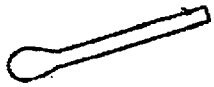
FIG. 12A is a partial schematic side elevation of a finger segment of a cone shaped funnel that may be used in an arrow rest of the present invention.
Figure 12B:
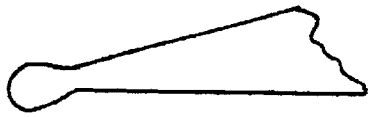
FIG. 12B is a partial schematic top elevation of the finger segment shown in FIG. 12A.

As shown in FIG. 12 the wedge-shaped fingers may each be formed with a teardrop or bulbous shaped tip. Such a design is believed to further reduce wear of the arrow shaft and of the arrow rest fingers and to reduce resistance and associated noise when drawing or shooting an arrow.

Figure 7:
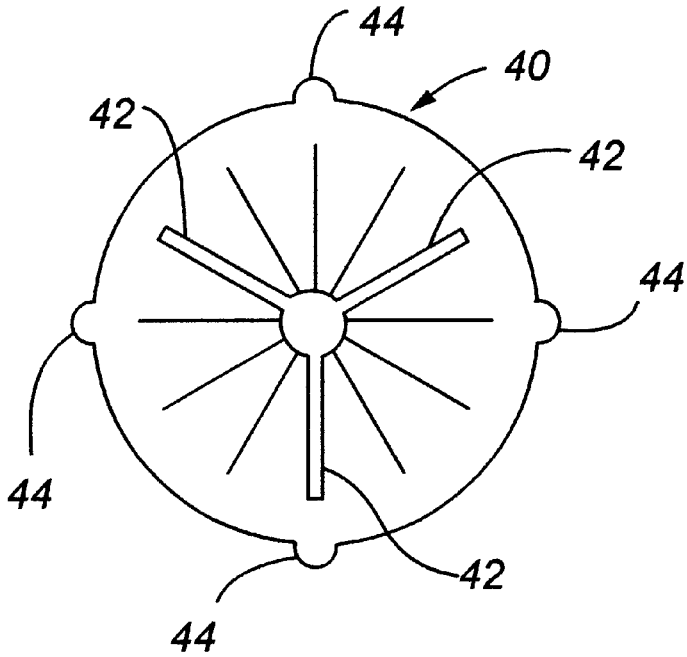
FIG. 7 is a schematic rear elevation of yet another cone shaped funnel that may be used in connection with the arrow rest as shown in FIGS. 1–3.

The funnel 22 maybe fashioned from a flat sheet of material that is die stamped and then rolled into a conical shape (as shown in FIG. 4) or may be injection molded (as shown in FIGS. 6 and 7). FIG. 4 depicts the ends of the sheet abutting along and forming the slit 30 upwardly extending at a 12:00 o'clock position. It should be appreciated that the funnel 22 may also be integrally formed with the ring 20.

In another preferred embodiment, the base end of the funnel 22 preferably possesses three to five ears or tabs 32 equiangularly arranged about the base end and extending radially outward therefrom. The ring 20 possesses an equal number of corresponding "T"-shaped guide key and slot openings 34, as best shown in FIGS. 2 and 3, which are also equiangularly disposed about the ring 20. Each guide key and slot opening is adapted to receive a corresponding one of the tabs 32 of the funnel 22. Although each tab 32 may be snugly or even compressively squeezed into the guide key and slot opening 34, it is preferred that each tab 32 be slightly loosely retained in its associated opening 34, as best shown in FIGS. 2 and 3. Such a condition will permit the funnel 22 to slightly shift with respect to the ring 22. Preferably, the shift is such that the longitudinal axis of the cone does not change more than about eight degrees. By permitting the funnel 22 to slightly shift with respect to the ring 20, when an arrow is shot, the shifting feature will permit any arrow shaft that is incorrectly fletched to pass more readily therethrough. Also, the funnel 22 will shift when an arrow with unmatched or misaligned fletching is shot. It should be apparent that instead of three equiangularly arranged tabs 32 and corresponding guide key and slot openings 34, the number and positioning of the tabs 32 and the guide key and slot 34 may be varied in accordance with the present invention.

Figure 11:
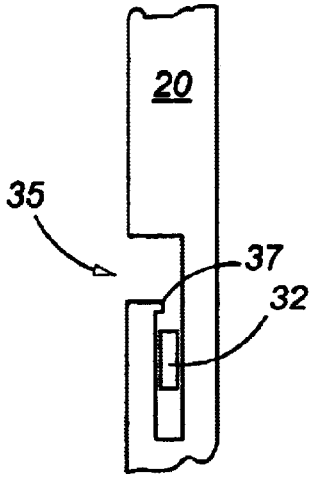
FIG. 11 is a partial schematic side elevation of a portion of a ring that may be used in an arrow rest according to the present invention.

Instead of a "T"-shaped guide key and slot opening 34, the ring 20 may possess "L"-shaped guide key and slot openings 35, as shown in FIG. 11. The length of the long leg of the "L"-shaped guide key and slot opening 35 is preferably longer than the length of the corresponding tab 32 so that the funnel 22 may be rotationally adjusted relative to the ring 20. Also, at least one of the "L"-shaped guide key and slot openings 35 possesses a lip 37 protruding inwardly at the juncture of the intersecting legs, as shown in FIG. 11, which lip 37 acts as a detente to selectively retain the corresponding tab 32. By manually flexing the ring 20 in the region of the lip 37, the tab 32 may be selectively inserted into or retrieved from a position of retention in the long leg of the "L"-shaped guide key and slot opening 35. The lip 37 is preferably about 1/32 to 1/16 inch long. Instead of the lip 37, a screw may selectively extend through the long leg section to selectively block the movement of the tab 32. Also the tab 32 may be crimped or pinched at a selected location within such position to fine tune the selected rotational position of the funnel 22 relative to the ring 20 such as by the use of a set screw (not shown), the end of which presses against the side of the tab 32 or by the use of screw (not shown) extending completely through the long leg section, which may be selectively tightened whereby the sides of the long leg section are pulled together.

It should be appreciated that the funnel 22 may be effectively utilized with arrows having three, four, six or other numbers of fletchings and may be effectively utilized with arrows having helical fletchings.

It should also be appreciated by those skilled in the art that the arrow rest assembly shown in FIGS. 1–3 may be readily adapted for use for either right-handed or left-handed bows.

FIG. 6 shows a schematic rear elevation of yet another funnel 36 that may be used in connection with the arrow rest assembly as shown in FIGS. 1–3. The funnel 36 is in all respects similar to the funnel 22 shown in FIGS. 4 and 5, except that there is no radially downward slit among the twelve slits 30, whereby a relatively large wedge-shaped finger 38 is centered radially beneath the central opening. The radially inner surface of the relatively large wedge-shaped finger 38 in the vicinity of the central aperture may be notched or fashioned in a "V"-shaped configuration to help center the arrow shaft within the central aperture and to help support the arrow shaft within the central aperture.

FIG. 7 shows a schematic rear elevation of yet another funnel 40 that may be used in connection with the arrow rest assembly shown in FIGS. 1–3. Of the twelve slits, three equiangularly arranged slits 42 are relatively wide, with a width in a range of about 2.5 to 5 millimeters. Also preferably each of the three slits 42 tapers from a relatively wide opening of about 2.5 to 3.5 millimeters near the base end to a relatively narrow opening of about 1.0 to 1.5 millimeters near the top end of the funnel 22. These three slits 42 are adapted for use with an arrow possessing three equiangularly arranged vanes so that when the arrow is shot, the vanes of the arrow may pass readily, without significant contact with the funnel 22, through the relatively wide slits 42. As shown in FIG. 7, the slits 42 are arranged for shooting an arrow with the cock vane down, in accordance with one preferred archery style. Also, it should be appreciated that the funnel 40 in FIG. 7 possesses four equiangularly arranged tabs 42 for cooperative mating with four equiangularly arranged key guide and slot openings in a ring. With such a construction, the funnel 40 may be rotated at 90 degree intervals, which permits the funnel 40 to be used for a shooting style in which the cock vane is horizontal, or vertically up, in accordance with other preferred archery styles. Moreover, when arrows utilizing four vanes are utilized, it is within the scope of the invention to utilize a funnel with four equiangularly spaced, relatively wide slits.

Figure 9:
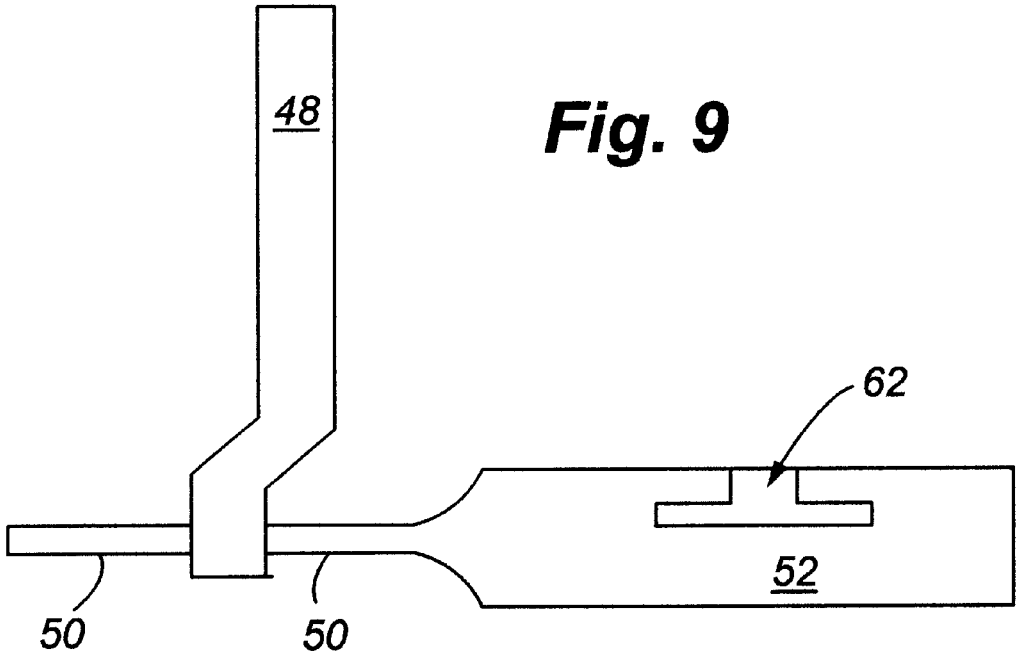
FIG. 9 is a schematic top elevation of the arrow rest shown in FIG. 8.
Figure 8:
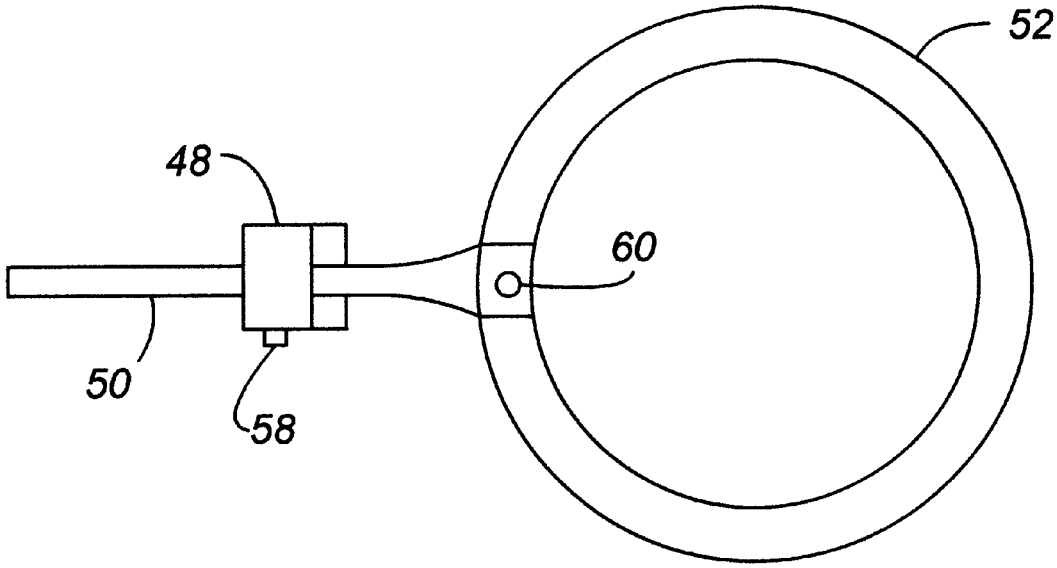
FIG. 8 is a schematic rear elevation of an arrow rest that may be used in connection with a cone shaped funnel of the present invention.
Figure 10:
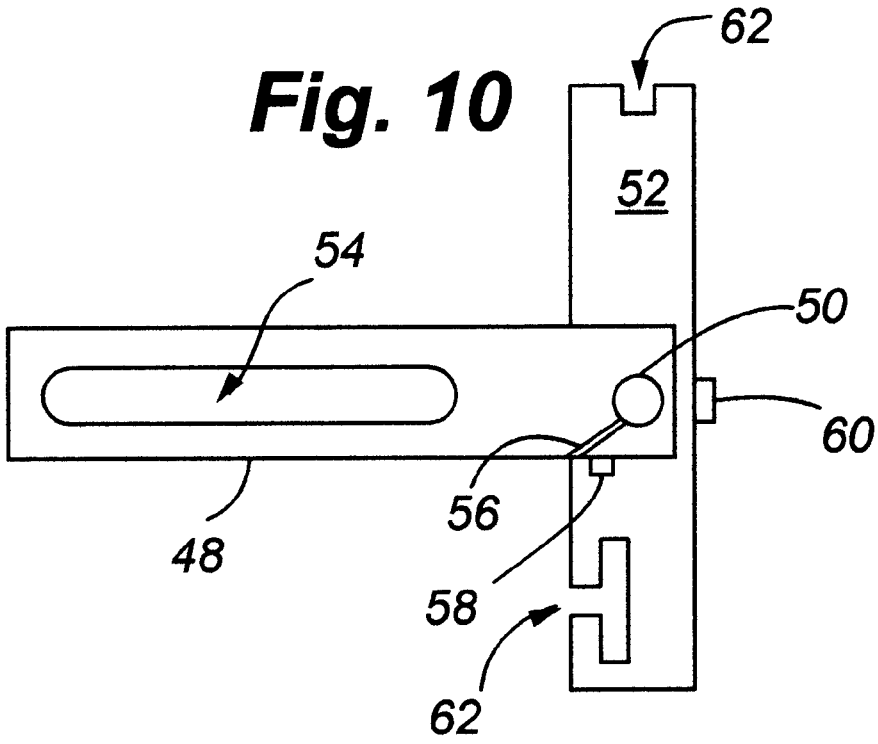
FIG. 10 is a schematic side elevation of the arrow rest shown in FIGS. 8 and 9.

FIGS. 9–10 show yet another arrow rest assembly in connection with which the funnel as shown in FIGS. 4–7 may be utilized. The arrow rest assembly includes a mounting bracket 48, a shaft 50, and a ring 52.

The mounting bracket 48 may be fashioned of a planar piece of metal and may assume a slightly bent shape as best shown in FIG. 9. One end of the bracket 48 includes an elongated slot 54, which is adapted to receive a conventional screw or bolt (not shown) adapted to extend into a conventional threaded receptacle (not shown) in the handle riser section of the bow 10.

The end of the mounting bracket 48 opposite the elongated slot 54 possesses a transverse hole therethrough, which is adapted to receive a rod or shaft 50 therethrough. The mounting bracket 12 includes a slot 56 extending from the transverse hole to the peripheral edge of the mounting bracket 48. A threaded hole extends upwardly from the bottom of the mounting bracket 48 through the slot 56 into which a threaded screw 58 may extend, whereby tightening of the screw 58 compresses the slot 56 and causes the transverse hole to assume a shorter periphery, whereby the shaft 50 may be clamped within the transverse hole. By loosening the screw 58, the shaft 56 may rotate and translate within the transverse hole, in the same manner as described with reference to the arrow rest assembly shown in FIGS. 1–3.

One distal end of the shaft 50 possesses a "Y" or yoke configuration which is adapted to be slidably received within mating recesses formed in the edges of the ring 52. A bore hole may extend through the yoke section of the shaft 50 and through the ring 52, and a pin or screw 60 may extend through the bore hole to secure the ring 52 to the shaft 50. The ring 52 may possess "T"-shaped key guide and slot openings 62 in all respects similar to the key guide and slot openings 34 as previously described with reference to the ring 20 in the arrow rest assembly as shown in FIGS. 1–3.

It should be appreciated that the arrow rest assembly shown in FIGS. 9–10 is also readily adapted for use with either a right-handed or left-handed bow. It will be appreciated that the arrow rest assembly of the present invention is especially useful for bow hunters, target/field archers and beginning archers, but may be effectively utilized by professional archers. Also, it should be appreciated that the arrow rest assemblies may accommodate different funnels, so that as a funnel becomes excessively worn, the funnel may be replaced with an identical funnel, or a funnel may be replaced with a different type of funnel, to accommodate different types of arrows or different types of archery styles. Thus, the funnels are replaceable and interchangeable.

Figure 13:
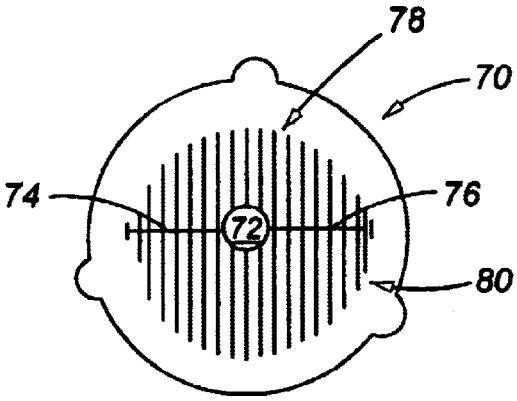
FIG. 13 is a schematic rear elevation of another cone shaped funnel that may be used in an arrow rest of the present invention.

FIG. 13 shows a schematic rear elevation of yet another funnel 70 that may be used in connection with the arrow rest assembly shown in FIGS. 1–3. The funnel 70 includes a central, circular aperture 72 through which the arrow shaft is adapted to extend when in a rest position. A pair of slits 74, 76 laterally extend from the central aperture 72. The funnel 70 includes an upper row of fingers or teeth 78, and a lower row of fingers or teeth 80, the distal ends which generally define the slits 74, 76. The teeth are somewhat akin to the teeth of a comb. The radially outer ends of the teeth generally form a circular pattern, as shown in FIG. 13, although other patterns are contemplated within the scope of the present invention. Also, the edge of the pattern may extend either further radially outward or further radially inward with respect to the configuration shown in FIG. 13. That is, the circular pattern may form a smaller or a larger circle than that shown in FIG. 13. In the embodiment shown in FIG. 13, the cone shape of the funnel 70 may be relatively shallow or flat, that is, the length of the cone from the base end to the top end may be very small, or even negligible.

It should be appreciated from FIG. 13 that the fingers or teeth are generally rectangularly shaped and extend vertically, with each finger or tooth being of approximately the same width. It is contemplated within the scope of the invention that the teeth in each row may have differing widths, that the teeth may not extend perfectly vertically, and that the teeth need not necessarily be perfectly rectangular.

Figure 14:
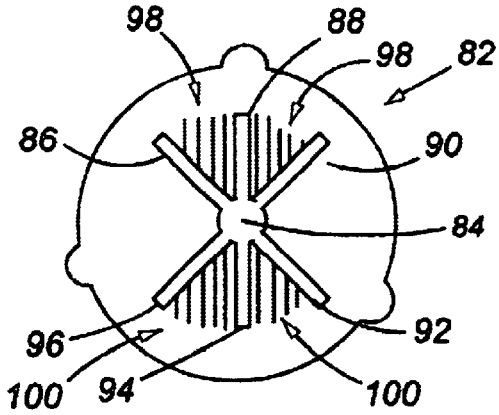
FIG. 14 is a schematic rear elevation of another cone shaped funnel that may be used in an arrow rest of the present invention.

There is shown in FIG. 14 yet another funnel 82 that may be used in connection with the arrow rest assembly shown in FIGS. 1–3. The funnel 82 possesses a central, circular aperture 84 adapted to receive the arrow shaft when in a rest position. In the embodiment shown in FIG. 14, relatively wide, generally rectangular slits 86, 88, 90, 92, 94, 96 extend from the central aperture 84 in an arcuate pattern at approximately 45 degrees, 90 degrees, 135 degrees, 225 degrees, 270 degrees, and 315 degrees, respectively. The relatively wide slits 86, 88, 90, 92, 94, 96 are adapted to permit the fletchings (either three or four fletches) of an arrow to readily pass therethrough. As shown in FIG. 14, the upper region defined between the slits 86 and 90, and the lower region define between the slits 92 and 96 may be fashioned in a row of fingers or teeth 98, 100 respectively. These teeth 98, 100 may be fashioned generally the same as the fingers or teeth 78, 80 described above with reference to FIG. 13.

It should be appreciated from FIG. 14 that the wedge shaped sections of the funnel 82 on each lateral side of the central aperture 84 are relatively stiff compared with the rows of teeth 98, 100. Consequently, it is believed that the funnel 82 shown in FIG. 14 may be especially beneficial for finger shooters, who do not use a mechanical release.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. An arrow rest adapted for use with an archery bow having a bowstring comprising:

(a) means for securing the arrow rest to an archery bow;

(b) a substantially conically shaped funnel adapted to be connected to said securing means, said funnel possessing a relatively large base end and a relatively small end defining an aperture through which the shaft of an arrow is adapted to extend when the arrow is in a "ready-to-draw-and-shoot" position, when the arrow is drawn rearwardly as the bowstring is drawn, and momentarily after release of the bowstring and during the initial shooting of the arrow, said funnel adapted to retain a substantially conical shape when the arrow is in a "ready-to-draw-and-shoot" position, and when the arrow is drawn rearwardly as the bowstring is drawn, wherein said aperture is substantially circular and wherein the diameter of said aperture in a rest condition is smaller than about 7 millimeters, wherein said relatively small end is resiliently flexible and is adapted to exert a radially inward, compressive force against the periphery of an arrow shaft extending through said aperture, and wherein said funnel in the region of said relatively small end is adapted to resiliently flex, whereby said aperture may widen and distend radially outward relative to said conical axis.

2. An arrow rest according to claim 1, wherein said substantially conical shape forms an angle with the axis of said cone substantially in the range of about 20 to 80 degrees.

3. An arrow rest according to claim 1, wherein said substantially conical shape forms an angle with the axis of said cone substantially in the range of about 30 to 60 degrees.

4. An arrow rest according to claim 1 wherein said funnel is fashioned substantially entirely from a unitary piece of material.

5. An arrow rest according to claim 4, wherein said material is selected from the group consisting of metal, nylon, polytetrafluorethylene, and polyethylene.

6. An arrow rest according to claim 1, wherein said funnel possesses a wall of substantially uniform thickness substantially in the range of between about 0.5 to 2.0 millimeters.

7. An arrow rest according to claim 1 wherein said funnel possesses a wall of substantially uniform thickness substantially in the range of between about 0.8 to 1.4 millimeters.

8. An arrow rest according to claim 1 wherein said relatively small end is flared substantially radially outwardly in the region defining said aperture.

9. An arrow rest according to claim 1 wherein said relatively small end includes a notched region adapted to be disposed beneath and to support the shaft of an arrow.

10. An arrow rest according to claim 1 wherein said funnel possesses a plurality of slits longitudinally extending from said relatively small end.

11. An arrow rest according to claim 1 wherein said plurality of slits are substantially equiangularly spaced from said relatively small end.

12. An arrow rest according to claim 11 wherein said funnel possesses at least four slits.

13. An arrow rest according to claim 12 wherein said funnel possess between 8 to 10 slits.

14. An arrow rest according to claim 11 wherein said funnel possesses either three or four slits adapted to receive the fletching of an arrow therethrough when the arrow is shot from the bow.

15. An arrow rest according to claim 14 wherein each slit possesses a width substantially in the range of about 2.5 to 5 millimeters.

16. An arrow rest according to claim 1 wherein said funnel is fashioned substantially of a plurality of substantially wedge-shaped fingers, wherein each wedge-shaped finger tapers toward said relatively small end.

17. An arrow rest according to claim 16 wherein said funnel is fashioned substantially of at least four substantially wedge-shaped fingers.

18. An arrow rest according to claim 16 wherein said funnel is fashioned substantially of between eight to ten substantially wedge-shaped fingers.

19. An arrow rest according to claim 1 wherein said relatively large base end possesses a diameter of about 3.5 to 5.5 centimeters.

20. An arrow rest according to claim 19 wherein said aperture defined by said relatively small end possesses a diameter of about 3.0 to 7.0 millimeters when said aperture is in a rest condition.

21. An arrow rest according to claim 1 wherein said relatively large base end possesses a diameter of about 4.0 to 5.0 centimeters.

22. An arrow rest according to claim 1 wherein said aperture defined by said relatively small end possesses a diameter of about 3.0 to 7.0 millimeters when said aperture is in a rest condition.

23. An arrow rest according to claim 1 which is reversible such that the arrow rest may be adapted for use with either a right-handed or a left-handed archery bow.

24. An arrow rest assembly adapted for use with an archery bow comprising:

a mounting bracket adapted to be selectively mounted on the archery bow;

a shaft adapted to be selectively translatable with respect to said mounting bracket;

means for attaching said shaft to said mounting bracket in a selected position of translation;

a ring connected to said shaft;

a funnel adapted to be secured to said ring, said funnel possessing a relatively large base end and a relatively small end defining an aperture through which the shaft of an arrow is adapted to extend when the arrow is in a "ready-to-draw-and-shoot" position, when the arrow is drawn rearwardly as the bowstring is drawn, and momentarily after release of the bowstring and during the initial shooting of the arrow, said funnel adapted to retain a substantially conical shape when the arrow is in a "ready-to-draw-and-shoot" position and when the arrow is drawn rearwardly as the bowstring is drawn, said funnel possessing at least one tab disposed near said relatively large end, and wherein the periphery of said ring possesses at least one key way and associated slot adapted to selectively receive said at least one tab whereby said funnel may be secured to said ring.

25. An arrow rest assembly according to claim 24 wherein said funnel possesses at least three tabs disposed substantially equiangularly near said relatively large base end and wherein the periphery of said ring possesses at least three key ways and associated slots substantially equiangularly spaced about the periphery and adapted to selectively receive a corresponding one of said tabs whereby said funnel may be secured to said ring.

26. An arrow rest assembly according to claim 25 wherein said at least three key ways and associated slots are adapted to loosely receive each corresponding one of said tabs such that said funnel may shift relative to said ring.

27. An arrow rest assembly according to claim 26 which is reversible such that the arrow rest may be adapted for use by either a right-handed or left-handed archery bow.

28. An arrow rest assembly according to claim 24 wherein said at least one key way and associated slot is adapted to loosely receive said at least one tab such that said funnel may shift relative to said ring.

29. An arrow rest assembly according to claim 24 wherein said funnel possesses a substantially conical shape.

30. An arrow rest assembly according to claim 24 wherein said funnel may shift substantially freely within about an eight degree are defined by the axis of said substantially conically shaped funnel.

31. An arrow rest assembly according to claim 30 which is reversible such that the arrow rest may be adapted for use by either a right-handed or left-handed archery bow.

32. An arrow rest assembly according to claim 24 which is reversible such that the arrow rest may be adapted for use by either a right-handed or left-handed archery bow.

33. A substantially conically shaped funnel adapted for use with an arrow rest adapted for use with an archery bow, said funnel possessing a relatively large base end and a relatively small end defining an aperture through with the shaft of an arrow is adapted to extend, said aperture being configured to substantially encompass the shaft of an arrow extending therethrough, said funnel adapted to resiliently flex in the region of said relatively small end whereby said relatively small end is adapted to exert a radially inward, compressive force against the periphery of an arrow shaft when the arrow shaft extends through said aperature, and whereby said aperture may distend radially outward relative to said conical axis and wherein said relatively small end is flared substantially radially outwardly in the region defining said aperture.

34. A funnel according to claim 33 wherein said relatively small end includes a notched region adapted to be disposed beneath and to support the shaft of an arrow.

35. A funnel according to claim 33 wherein said funnel is fashioned substantially of a plurality of fingers.

36. A funnel according to claim 35 wherein said funnel is fashioned substantially of at least four substantially wedge-shaped fingers, wherein each wedge-shaped finger tapers toward said relatively small end.

37. A funnel according to claim 35 wherein said funnel is fashioned substantially of between eight to ten substantially wedge-shaped fingers, wherein each wedge-shaped finger tapers toward said relatively small end.

* * * * *